United States Patent [19]

Wessel

[11] 3,981,288

[45] Sept. 21, 1976

[54] APPARATUS FOR REDUCING THE TOXIC COMPONENTS IN THE EXHAUST GAS OF INTERNAL COMBUSTION ENGINES

[75] Inventor: Wolf Wessel, Schwieberdingen, Germany

[73] Assignee: Robert Bosch G.m.b.H., Stuttgart, Germany

[22] Filed: Apr. 28, 1975

[21] Appl. No.: 572,286

[30] Foreign Application Priority Data

May 13, 1974 Germany ..... 2423111

[52] U.S. Cl. ..... 123/139 AW; 123/32 EA; 123/140 MC; 60/285

[51] Int. Cl.[2] ..... F02M 1/04; F01N 3/00

[58] Field of Search .... 123/32 EA, 139 E, 139 AW, 123/140 MC; 60/285

[56] References Cited

UNITED STATES PATENTS

| | | | |
|---|---|---|---|
| 3,796,200 | 3/1974 | Knapp | 60/285 |
| 3,827,237 | 8/1974 | Linden et al. | 123/32 EA |
| 3,868,819 | 3/1975 | Knapp | 60/285 |
| 3,874,171 | 4/1975 | Schmidt et al. | 123/32 EA |

*Primary Examiner*—Charles J. Myhre
*Assistant Examiner*—Paul Devinsky
*Attorney, Agent, or Firm*—Edwin E. Greigg

[57] ABSTRACT

A fuel supply and metering valve assembly used for injection of fuel to an internal combustion engine includes a control pressure circuit which determines the restoring force on the movable member of the fuel metering valve. The magnitude of the control pressure, and hence the fuel quantity metered out by the valve assembly can be altered by the intermittent actuation of a pressure relief valve which controls a fluid bypass. The duty cycle of the intermittently acting bypass valve is controlled by a regulating device which responds to the indications of measuring transducers, for example an oxygen probe located in the exhaust line of the engine. The transducer signal is superimposed on a sawtooth voltage at the input of a differential amplifier which interacts with other control circuitry so as to vary the length of time during which the electromagnetic bypass valve is energized.

7 Claims, 5 Drawing Figures

APPARATUS FOR REDUCING THE TOXIC COMPONENTS IN THE EXHAUST GAS OF INTERNAL COMBUSTION ENGINES

BACKGROUND OF THE INVENTION

The present invention relates to an apparatus for reducing the toxic components in the exhaust gas of internal combustion engines by influencing the mass ratio of the fuel-air mixture supplied to the internal combustion engine, effected by varying the keying ratio (duty cycle) of a cyclically actuated electromagnetic valve disposed in the control pressure circuit of an engine fuel supply system. The electromagnetic valve is controlled by a regulating device in response to data from measuring transducers which monitor various operating parameters of the internal combustion engine.

Apparatuses of this type are designed to automatically provide a favorable fuel-air mixture for all operating conditions of the internal combustion engine so as to burn the fuel as completely as possible and thus prevent toxic gases from being produced, or, at least, to considerably reduce the amount of toxic gases while obtaining maximum performance of the internal combustion engine or minimum fuel consumption, as desired. For this purpose, the quantity of fuel must be very accurately metered out in accordance with the requirements of each operating state of the internal combustion engine and the air-fuel ratio must be varied as a function of engine operating parameters such as speed, load, temperature and exhaust gas composition.

In known apparatuses for reducing the toxic components in the exhaust gas of internal combustion engines, an electromagnetic valve, cycled by an electronic regulating device as a function of the operating parameters of the internal combustion engine is disposed in a control pressure circuit for the purpose of varying a control pressure which, in turn, affects the fuel-air ratio. When electronic regulating devices of this type are used in motor vehicles, they are exposed to the effects of temperature and aging which produce undesirable variations in the keying ratio of the electromagnetic valve.

OBJECT AND SUMMARY OF THE INVENTION

It is a principal object of the present invention to provide an apparatus for reducing the toxic components in the exhaust gas of internal combustion engines by means of which it is possible to achieve rapid and accurate readjustment of the mass ratio of the fuel-air mixture supplied to the internal combustion engine while avoiding the effects of temperature and aging which would produce undesirable variations in the keying ratio of the electromagnetic valve.

According to the invention, this object is achieved by providing a sawtooth generator which produces a sawtooth voltage of constant frequency and amplitude which is used to vary the keying ratio of the electromagnetic valve. The sawtooth voltage is superimposed on a constant voltage, characteristic of engine operating parameters, and is applied to the inverting input of a summing amplifier of the regulating device. A predetermined voltage, derived from a voltage divider, is applied to the non-inverting input of the summing amplifier.

An advantageous feature of the invention provides that the output of the summing amplifier is connected through a resistor to a positive voltage source and, through a second, parallel resistor, to the base of a first transistor whose emitter is connected to the positive supply line and whose collector is connected to the negative voltage source through a voltage divider. Connected to the tap of the voltage divider is the base of a second transistor, whose emitter is connected to the base of a third transistor and to the negative supply line through a resistor. The collector of the second transistor is connected, via the windings of the electromagnetic valve, to the positive supply line and to the collector of the third transistor, the emitter of which is connected to the negative supply line.

Another advantageous feature of the invention provides that the sawtooth voltage comprises linear segments. It further provides that the sawtooth generator comprises an integrator whose non-inverting input is connected to the tap of a voltage divider containing two resistors and whose output, which carries the sawtooth voltage, is connected through a resistor to the non-inverting input of a switching amplifier or comparator, the inverting input of which is connected through a resistor to a voltage divider comprising two resistors and whose output is connected through a resistor to the inverting input of the integrator.

Another advantageous embodiment of the invention provides that the sawtooth voltage has portions corresponding to an exponential function, more particularly, a function of the type $y = e^x$, hereinafter referred to as an $e$-function, and in that the sawtooth generator comprises a first transistor, the base of which is connected to a capacitor coupled to the negative supply line and the emitter of which is connected through a resistor to the positive supply line and with the base of a complementary transistor, while its collector is connected to the negative supply line. The collector of the complementary transistor is connected to the positive line, and the emitter, which carries the sawtooth voltage, is connected through a resistor to the negative line and, through a further resistor to the inverting input of a switching amplifier. The non-inverting input of the switching amplifier is connected through a resistor to the tap of a voltage divider comprising two resistors and the output is connected through a resistor to the base of the first transistor and to the capacitor.

One major advantage of the apparatus according to the invention for reducing the amount of toxic components in the exhaust gas of internal combustion engines when compared, for example, to a device comprising a free-running oscillator connected in series with a controllable monostable multivibrator lies in that there is no change in the keying ratio (duty period) of the electromagnetic valve even if variations occur in the frequency of the sawtooth voltage, due, for example, to the effects of temperature and aging.

The advantage of using a sawtooth generator which produces a sawtooth voltage with segments that correspond to an $e$-function as compared to a sawtooth generator producing a sawtooth voltage with linear segments is that the former is substantially less sensitive to disturbing voltage peaks which may occur in the wiring systems of motor vehicles.

The invention will be better understood as well as further objects and advantages become more apparent from the ensuing detailed specification of two preferred, although exemplary embodiments taken in conjunction with the drawing.

DESCRIPTION OF THE PREFERRED EMBODIMENTS

Figure 1:
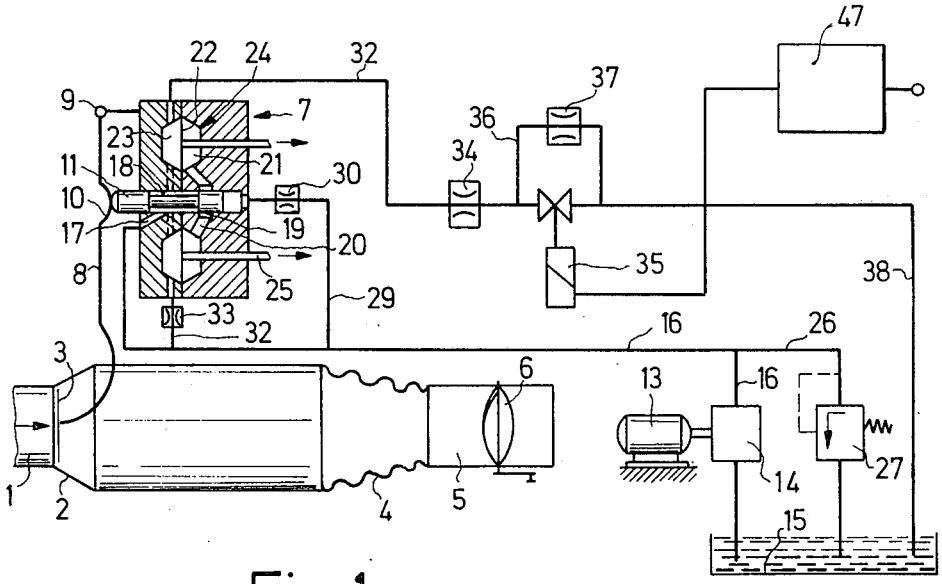
FIG. 1 is a partly schematic diagram of a first embodiment of the apparatus according to the invention for influencing the mass ratio of the fuel-air mixture supplied to an internal combustion engine.

Turning now to FIG. 1, it may be seen that the combustion air flows in the direction of the arrow through an induction tube 1 containing a measuring sensor 3 within a conical region 2. The air then flows through a coupling hose 4 and an induction tube region 5, containing an arbitrarily actuatable butterfly valve 6, to one or more cylinders (not shown) of the internal combustion engine. The sensor 3 is a plate disposed at right angles to the direction of air flow and it is deflected within the conical region 2 according to an approximately linear function of the air flow rate through the induction tube. If the restoring force exerted on the sensor 3 and the pressure prevailing upstream of the sensor 3 are both constant, then the pressure prevailing between the air sensor 3 and the butterfly valve 6 also remains constant.

The sensor 3 directly controls a fuel metering and distributing valve 7. A lever 8, connected to the sensor and mounted pivotably and in a largely frictionless manner, has a nose 10 which, during the pivoting movements of the lever, actuates the movable member of the fuel metering and distributing valve 7 which is embodied as a control slide 11.

Fuel is supplied by a fuel pump 14, driven by an electric motor 13, from a fuel tank 15 and is delivered through a fuel supply line 16 and a channel 17 to an annular groove 18 on the control slide 11. Depending on the position of the control slide 11, the annular groove 18 opens, to a greater or lesser extent, control slits 19, each of which leads through a channel 20 to a chamber 21. Each chamber 21 is separated from a chamber 23 by a diaphragm 22 which serves as the movable part of a flat-seat valve acting as a pressure-equalizing valve. From the chamber 21, the fuel is admitted through injection channels 25 to the individual fuel injection valves (not shown) which are located in the induction tube in the vicinity of the engine cylinders.

From the fuel supply line 16 extends a line 26 in which is disposed a pressure limiting valve 27. When there is excessive pressure in the system, the pressure limiting valve allows fuel to flow back into the fuel tank 15.

The face of the control slide 11 remote from lever 8 is exposed to the force of pressurized fluid which provides a restoring force for the sensor 3 and which exerts its force through a line 29 including a damping throttle 30.

Also extending from the line 16 is a line 32 including, in series, a first throttle 33, the chambers 23 of the pressure-equalizing valves 24, a second throttle 34 and an electromagnetic valve 35. Connected in parallel to the electromagnetic valve 35 is a line 36 containing a third throttle 37 through which the fuel in the control pressure circuit 32 may return to the fuel tank without gauge pressure via the return flow line 38.

The apparatus shown in FIG. 1 operates as follows:

When the internal combustion engine is running, air is drawn in through the induction tube 1, 4 and 5 and, as a result, the sensor 3 is displaced from its rest position. In response to the deflection of the sensor 3, the control slide 11 of the fuel metering and distributing valve 7, which meters the quantity of fuel flowing to the injection valves, is displaced by the lever 8. The direct, positive coupling between the sensor 3 and the control slide 11 insures a constant ratio of the quantity of air to the metered-out quantity of fuel.

In order to adapt the fuel-air mixture to particular operating conditions of the internal combustion engine, it may be necessary to vary the pressure difference across the metering valve locations 18,19. The pressure difference across these metering valve locations can be advantageously regulated and varied in common by varying the pressure in the control pressure circuit 32. In the present embodiment, the differential pressure across the metering valve locations 18,19 is varied by changing the differential pressure across the first throttle 33, by varying the quantity of fluid flowing through it. This variation of the flow through the first throttle 33 is made possible by the presence, in the control pressure circuit 32, of a second throttle 34 and an electromagnetic valve 35 with a third throttle 37 disposed in parallel thereto, all downstream of the first throttle 33. When the electromagnetic valve 35 is closed, the quantity of fuel flowing through the throttle 33 is determined by the throttles 33, 34 and 37, whereas, when the electromagnetic valve is open, the quantity of fuel flowing in the control pressure circuit is determined by the throttles 33 and 34 alone, resulting in a reduced throttling action and an increased pressure difference across the first throttle 33. As a result, the pressure difference at the metering valve locations 18,19 is also increased. The pressure difference across the first throttle 33 may be changed by varying the ratio of the duration of the open period to the closed period, i.e., by varying the keying ratio or duty factor of the electromagnetic valve 35. When the electromagnetic valve remains closed, the pressure difference is at a minimum and a lean fuel-air mixture is obtained, whereas, when the electromagnetic valve 35 remains open, the pressure difference is at a maximum and the fuel-air mixture is richest.

A storage element (not shown) could be provided in the control pressure circuit for any required damping of pressure fluctuations.

Figure 2:
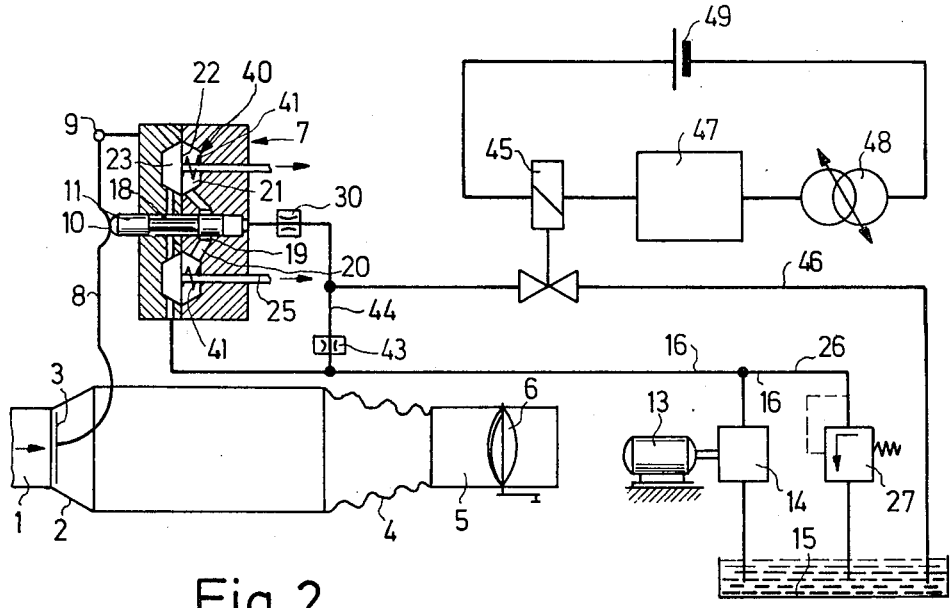
FIG. 2 is a similar diagram of a second embodiment for influencing the mass ratio of the fuel-air mixture supplied to the internal combustion engine.

As shown in FIG. 2, the electromagnetic valve 35 is cyclically actuated and is controlled by, for example, an oxygen probe disposed in the exhaust gas conduit of the internal combustion engine which acts through an electronic regulator device.

In FIG. 2 those parts of the apparatus which are the same as the parts shown in FIG. 1 retain the same reference numerals. The fuel delivered by the fuel pump 14 flows through the fuel supply conduit 16 into the chambers 23 of differential pressure valves 40 and to the annular groove 18 of the control slide 11. The fuel which is metered out at the control slits 19 flows through the channels 20 into the chambers 21 of the differential pressure valves 40, each of which contains a spring 41 which exerts a force urging the differential pressure valves in the opening direction. The differential pressure valves 40 maintain a constant pressure difference across the metering valve locations 18,19 and this pressure difference is independent of the quantity of fuel flowing through the channels 25 to the injection valves. A throttle 43 uncouples the fuel supply line 16 from the control pressure circuit 44. The control pressure fluid exerts a force on the face of the control slide 11 far from lever 8 and thus produces the restoring force for the sensor 3. The control pressure circuit 44 also includes an electromagnetic valve 45. When the electromagnetic valve 45 is open, it permits a return of the pressurized fluid through a return flow line 46 into the fuel tank 15. The electromagnetic valve 45 is controlled, via an electronic regulating device 47, by a measuring transducer for determining the operating parameters of the internal combustion engine. In the present exemplary embodiment, this transducer is a so-called oxygen probe 48, disposed in the exhaust gas line. The oxygen probe 48 is a part of an electric circuit which includes a voltage source 49.

Figure 3:
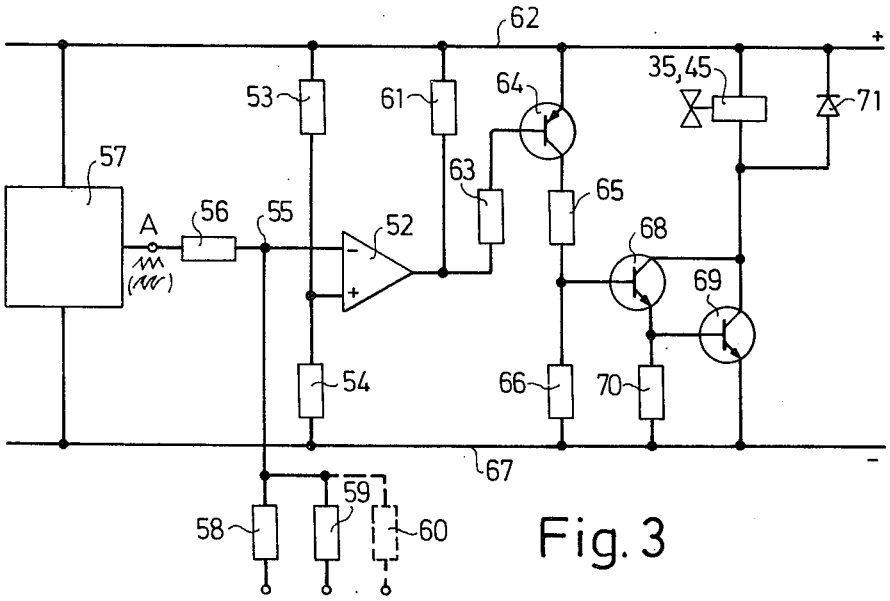
FIG. 3 is a circuit diagram of the electronic regulating device used in the apparatus according to the invention.

The electronic regulating device 47 is shown in detail in FIG. 3, and contains a summing amplifier 52 whose non-inverting input is connected to the tap of a voltage divider consisting of two resistors 53 and 54. The inverting input of the summing amplifier 52 is connected to a summing point 55 which is connected, through a resistor 56, to the output A of a sawtooth generator 57 and, through parallel resistors 58,59,60, to various transducers which monitor the operating parameters of the internal combustion engine. The output of the summing amplifier 52 is connected through a resistor 61 to a positive supply line 62, and, through a resistor 63, which is parallel to the resistor 61, to the base of a first transistor 64. The emitter of transistor 64 is connected to the positive line 62 and its collector is connected to a negative supply line 67 via a voltage divider circuit including two resistors 65,66. The base of a second transistor 68 is connected to the tap of the voltage divider circuit 65,66. The emitter of the second transistor 68 is connected to the base of a third transistor 69 and to a resistor 70, connected to the line 67. The emitter of the third transistor 69 is also connected to the negative line 67 while its collector is connected to the collector of the second transistor 68 and also to the positive line 62 via the windings of the electromagnetic valve 35,45. A diode 71 is connected in parallel with the windings of the electromagnetic valve 35,45.

The method of operation of the electronic regulating device represented in FIG. 3 is as follows:

Assuming, by way of example, that only one of the operating parameters determined by a transducer is present, in the form of the voltage $U_e$, at one of the resistors 58–60. If, for example, the voltage $U_e$ has the value 0 V, the voltage at the summing point 55 will be determined by the sawtooth voltage $U_f$, by $U_e$ and by the voltage dividers 56,58. For low values of the sawtooth voltage $U_f$, the voltage at the summing point 55 will be below the voltage $U_m$ at the non-inverting input of the summing amplifier 52 and determined by the voltage divider chain 53,54. Therefore, the output voltage of the summing amplifier 52 equals the positive supply potential, the transistors 64,68,69 are blocked and the electromagnetic valve 35,45 is currentless. As the sawtooth voltage $U_f$ rises, and the voltage at the summing point 55 equals the value $U_m$, the amplifier output is switched over to the negative potential, possibly aided by a feedback resistor (not shown).

As a result, the transistors 64,68,69 are rendered conducting and the magnetic valve is opened by the current flowing through its windings. The sawtooth voltage $U_f$ decreases after passing through its maximum value and when it reaches the value $U_m$, the summing amplifier 52 again switches over to the positive potential, whereupon the transistors 64,68,69 block and the electromagnetic valve 35,45 is currentless and closes.

For any arbitrary positive value of the voltage $U_e$, the switch-over point which occurs during an increasing sawtooth voltage $U_f$, will be reached earlier, whereas the switch-over point which occurs during a decreasing sawtooth voltage $U_f$, will be reached later, with the result that the pulse duration is increased by comparison with the above-described example in which $U_e = 0$. Thus, it is possible to vary the pulse duration for controlling the electromagnetic valve in dependence on operating parameters characterized by the voltage $U_e$. The same discussion applies to any other voltages $U_e$, characterizing further operating parameters.

Figure 4:
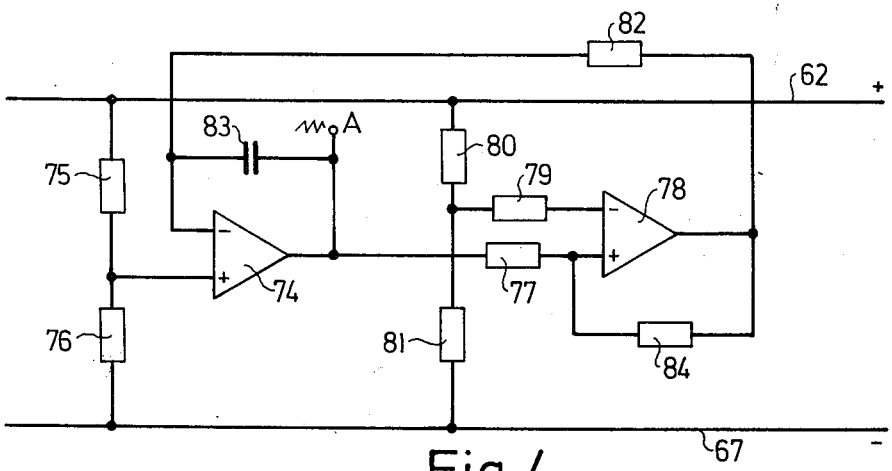
FIG. 4 is a circuit diagram of a sawtooth generator for producing a sawtooth voltage with linear segments.

FIG. 4 is the circuit diagram of a sawtooth generator which supplies a sawtooth voltage comprising linear segments, thereby producing a linear relationship between the voltage $U_e$ and the keying ratio (duty factor) of the electromagnetic valve. The sawtooth generator includes an amplifier connected as an integrator 74. The non-inverting input of the amplifier is connected to the tap point of a voltage divider circuit including two resistors 75,76 and its output is connected through a resistor 77 to the non-inverting input of a switching amplifier 78. The inverting input of the switching amplifier 78 is connected through a resistor 79 to the tap point of a voltage divider circuit including two resistors 80,81 and its output is connected through a resistor 82 back to the inverting input of the integrator 74. An integrating capacitor 83 is connected between the inverting input of the integrator 74 and the output. The non-inverting input and the output of the switching amplifier 78 are connected through a resistor 84.

The sawtooth generator shown in FIG. 4 operates as follows:

Depending on whether the output of the switching amplifier 78 is positive or negative, the voltage at the non-inverting input is made positive or negative via the feedback resistor 84 by a specific amount determined by the voltage divider 77,84. If, for example, the switching amplifier 78 is switched to a negative potential, then the non-inverting input of the switching amplifier is more negative than the inverting input and, thus, this switching state initially remains stable. Since current now begins to flow out of the integrating capacitor 83 through the resistor 82, the output voltage of the integrator 74, which corresponds to the sawtooth voltage $U_f$, rises in a linear manner. When the sawtooth voltage $U_f$ is sufficiently high, the voltage at the tap of the voltage divider 77,84 becomes equal to the voltage at the inverting input and the output of the switching amplifier 78 switches over to a positive potential. Current now flows through the resistor 82 into the integrating capacitor 83 and the sawtooth voltage at the output A of the integrator 74 decreases in a linear manner. When the sawtooth voltage $U_f$ has decreased to the point where the voltage at the tap of the voltage divider 77,84 is again lower than the voltage at the inverting input of the switching amplifier 78, the swtiching amplifier switches back again to minus and the sawtooth voltage $U_f$ again increases, etc.

Figure 5:
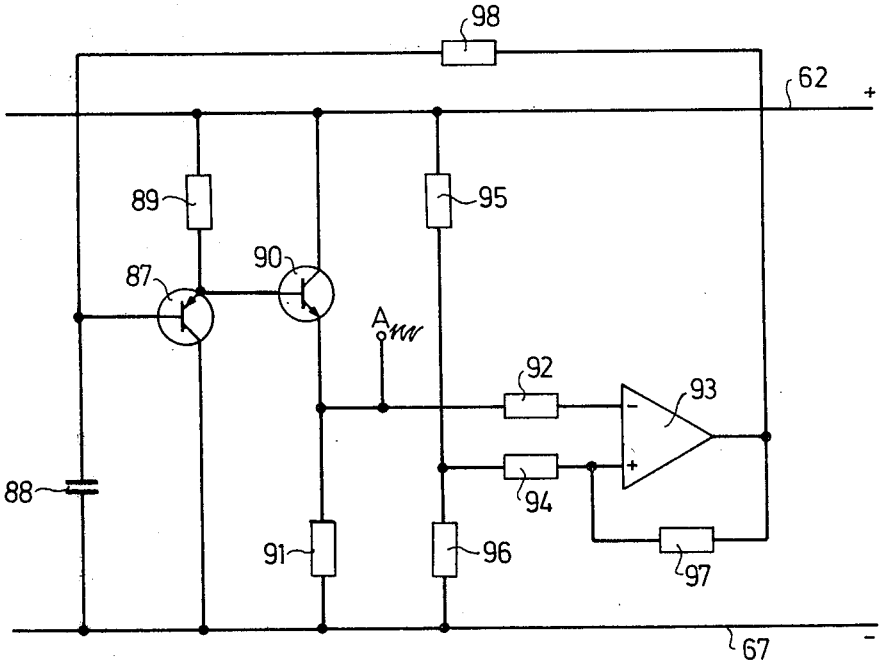
FIG. 5 is a circuit diagram of a sawtooth generator for producing a sawtooth voltage with segments corresponding to an *e*-function.

To eliminate the influence of disturbing voltage peaks which occur in the wiring system of motor vehicles, it may be advantageous to employ a substantially less sensitive sawtooth generator which supplies a sawtooth voltage comprising segments corresponding to an *e*-function. FIG. 5 is a circuit diagram for producing a sawtooth voltage with *e*-function segments. In this circuit, the base of a transistor 87 is connected to a capacitor 88, which in turn, is connected to the negative supply line 67. The emitter of the transistor 87 is connected to the positive line 62 through a resistor 89 and also to the base of a complementary transistor 90. The collector of the transistor 87 is connected to the negative line 67. The collector of the complementary transistor 90 is connected to the positive line and its emitter to the negative lines 67 through a resistor 91. The emitter of transistor 90 is also connected, through a further resistor 92, to the inverting input of a switching amplifier 93. The non-inverting input of the switching amplifier 93 is connected through a resistor 94 to the tap point of a voltage divider circuit consisting of two resistors 95,96 and via a feedback resistor 97, to the output of the switching amplifier 93. The output of the switching amplifier 93 is also connected, through a resistor 98, to the base of the transistor 87 and to the capacitor 88.

When the switching amplifier 93 has just been switched to the negative side, the voltage at its non-inverting input is determined by the voltage at the tap point of the voltage divider 95,96 and by the voltage divider 94,97 and is thus smaller than the voltage at the tap point of the voltage divider 95,96. The capacitor 88 discharges through the resistor 98 and, thus, the sawtooth voltage $U_f$, which may be tapped off at the emitter of the complementary transistor 90, is decreasing. When the sawtooth voltage $U_f$, supplied to the inverting input of the switching amplifier 93 through the resistor 92, reaches the value of the voltage present at the non-inverting input, the output of the switching amplifier switches over to plus. Now the voltage divider 94,97 makes the voltage at the non-inverting input more positive than is the voltage at the tap point of the voltage divider 95,96 and the capacitor 88 charges through the resistor 98. When the sawtooth voltage $U_f$ again reaches the value present at the non-inverting input, the switching amplifier 93 switches back to minus.

When employing a sawtooth voltage with segments corresponding to an *e*-function, it is advantageous if the utilized operating range lies between 20 and 80 percent of the maximum value, so that the deviation from linearity is negligibly small.

What is claimed is:

1. In an apparatus for reducing the concentration of toxic components in the exhaust has of an internal combustion engine, which engine includes a fuel supply system, a fuel metering system and a control pressure circuit for controlling said fuel metering system, said control pressure circuit including an electromagnetic valve which controls a fuel bypass, said apparatus further including a regulating device which accepts control information signals from sensors monitoring the value of engine parameters and which cyclically actuates and controls said electromagnetic valve to intermittently actuate the fluid bypass, the improvement comprising the regulating device for controlling the electromagnetic valve including:

an electric signal generator, having an output connection and generating sawtooth signals of constant frequency and amplitude;

summing amplifier means, having an inverting and a non-inverting input connection and an output connection;

first resistive means, connected to the output of said electric signal generator and connected to receive said control information signals from said sensors, and to effect electrical superposition of said sawtooth signals and said control information signals and further connected to said inverting input of said summing amplifier;

second resistive means, including too resistors connected as a voltage divider circuit and providing a predetermined voltage to said non-inverting input of said summing amplifier;

whereby signals appearing at said output of said summing amplifier mediately affect the energization timing of said electromagnetic valve, thereby changing the mass ratio of the fuel-air mixture supplied to said internal combustion engine.

2. An apparatus as defined in claim 1, wherein said regulating device further includes:

positive and negative voltage sources;

a resistor, connected between said output of said summing amplifier and said positive voltage source;

a first transistor whose emitter is connected to said positive voltage source;

a resistor, connected between the output of said summing amplifier and the base of said first transistor;

resistive voltage divider means, connected between the collector of said first transistor and said negative voltage source;

a second transistor, whose base is connected to the tap of said voltage divider means and whose collector is connected through the windings of said electromagnetic valve to said positive voltage source;

a resistor, connected between the emitter of said second transistor and said negative voltage source; and a third transistor, whose emitter is connected to said negative voltage source, whose base is connected to the emitter of said second transistor and whose collector is connected to the collector of said second transistor.

3. An apparatus as defined in claim 1, wherein said electric signal generator generates sawtooth signals which have linear waveform segments.

4. An apparatus as defined in claim 3, wherein said electric signal generator includes:

integrator means, having an inverting and a non-inverting input and an output;

two resistors, connected as a first voltage divider circuit between said positive and negative voltage sources, whose junction is connected to the non-inverting input of said integrator means;

a switching amplifier with an inverting and a non-inverting input and an output;

a resistor, connected between the output of said integrator means and the non-inverting input of said switching amplifier;

two resistors, connected as a second voltage divider circuit between said positive and negative voltage sources;

a resistor, connected between the tap of said second voltage divider circuit and the inverting input of said switching amplifier; and a resistor, connected between the output of said switching amplifier and the inverting input of said integrator means; whereby the sawtooth voltage may be obtained at the output of said integrator means.

5. An apparatus as defined in claim 1, wherein said electrical signal generator generates sawtooth signals which have exponential segments.

6. An apparatus as defined in claim 5, wherein each of said exponential segments conforms substantially to the function $Y=e^x$, in which $e$ is the base of natural logarithms.

7. An apparatus as defined in claim 6, wherein said electric signal generator includes:

a first transistor, whose collector is connected to the negative voltage source;

a capacitor, connected between the base of said first transistor and the negative voltage source;

a resistor, connected between the emitter of said first transistor and the positive voltage source;

a complementary transistor, whose collector is connected to the positive voltage source and whose base is connected to the emitter of said first transistor;

a resistor, connected between the emitter of said complementary transistor and the negative voltage source;

a switching amplifier with an inverting and a non-inverting input and an output;

a resistor, connected between the inverting input of said switching amplifier and the emitter of said complementary transistor;

two resistors, connected as a voltage divider circuit between the positive and negative voltage sources;

a resistor, connected between the tap of said voltage divider circuit and the non-inverting input of said switching amplifier; and a resistor, connected from the output of said switching amplifier to the base of said first transistor and to said capacitor; whereby the sawtooth voltage signal may be obtained at the emitter of said complementary transistor.

* * * * *